US008733469B2

(12) United States Patent
Konschuh et al.

(10) Patent No.: US 8,733,469 B2
(45) Date of Patent: May 27, 2014

(54) PULSE GENERATOR

(75) Inventors: Christopher Konschuh, Calgary (CA); Laurier E. Comeau, Calgary (CA)

(73) Assignee: Xtend Energy Services, Inc., Calgary, Alberta (CA)

( * ) Notice: Subject to any disclaimer, the term of this patent is extended or adjusted under 35 U.S.C. 154(b) by 337 days.

(21) Appl. No.: 13/029,548

(22) Filed: Feb. 17, 2011

(65) Prior Publication Data

US 2012/0211251 A1 Aug. 23, 2012

(51) Int. Cl.
*E21B 4/14* (2006.01)

(52) U.S. Cl.
USPC ..... 173/201; 175/297

(58) Field of Classification Search
USPC ..... 173/200, 201; 175/296, 297; 166/249, 166/177.6, 177.7
See application file for complete search history.

(56) References Cited

U.S. PATENT DOCUMENTS

| | | | | |
|---|---|---|---|---|
| 2,743,083 | A | 4/1956 | Zublin | |
| 2,780,438 | A | 2/1957 | Bielstein | |
| 3,455,401 | A * | 7/1969 | Taylor, Jr. | 175/45 |
| 4,819,745 | A | 4/1989 | Walter | |
| 4,830,122 | A | 5/1989 | Walter | |
| 4,953,595 | A | 9/1990 | Kotlyar | |
| 4,979,577 | A | 12/1990 | Walter | |
| 5,009,272 | A | 4/1991 | Walter | |
| 5,048,622 | A | 9/1991 | Ide | |
| 5,190,114 | A | 3/1993 | Walter | |
| 5,321,213 | A * | 6/1994 | Cole et al. | 181/106 |
| 5,582,247 | A * | 12/1996 | Brett et al. | 166/249 |
| 6,279,670 | B1 | 8/2001 | Eddison et al. | |
| 6,289,596 | B1 | 9/2001 | Anderson et al. | |
| 6,321,857 | B1 | 11/2001 | Eddison | |
| 6,431,294 | B1 | 8/2002 | Eddison et al. | |
| 6,439,318 | B1 | 8/2002 | Eddison et al. | |
| 6,508,317 | B2 * | 1/2003 | Eddison et al. | 175/107 |
| 6,588,518 | B2 | 7/2003 | Eddison | |
| 6,615,933 | B1 | 9/2003 | Eddison | |
| 6,898,150 | B2 * | 5/2005 | Hahn et al. | 367/85 |
| 7,013,994 | B2 | 3/2006 | Eddison | |
| 7,077,205 | B2 | 7/2006 | Eddison | |
| 7,168,493 | B2 | 1/2007 | Eddison | |
| 7,234,543 | B2 * | 6/2007 | Schaaf | 175/61 |

(Continued)

FOREIGN PATENT DOCUMENTS

| | | |
|---|---|---|
| EP | 0335543 A1 | 10/1989 |
| GB | 2059481 | 4/1981 |
| GB | 2405419 | 2/2005 |
| WO | 02072993 | 9/2002 |

OTHER PUBLICATIONS

Great Britain Search Report and Search Opinion for GB Application No. 1201375.1, dated Feb. 8, 2012, 3 pages.

(Continued)

*Primary Examiner* — Andrew M Tecco
(74) *Attorney, Agent, or Firm* — Wong, Cabello, Lutsch, Rutherford & Brucculeri, LLP.

(57) ABSTRACT

A downhole tool comprises a pulse generator that can generate longitudinal pulses in a drill string. A poppet is longitudinally moved in and out of an orifice in the pulse generator reducing the flow of drilling mud temporarily, generating a longitudinal pulse. The longitudinal pulse generator may be combined with a conventional transverse pulse generator to create a pulse generator capable of generating pulses in both transverse and longitudinal directions.

15 Claims, 5 Drawing Sheets

(56) References Cited

U.S. PATENT DOCUMENTS

| | | | | |
|---|---|---|---|---|
| 7,423,932 | B1 * | 9/2008 | Jeter | 367/85 |
| 7,430,153 | B2 * | 9/2008 | Fraser et al. | 367/85 |
| 7,673,705 | B2 * | 3/2010 | Gearhart et al. | 175/40 |
| 7,703,553 | B2 | 4/2010 | Eddison et al. | |
| 2004/0089461 | A1 * | 5/2004 | Cioceanu | 173/90 |
| 2009/0301710 | A1 * | 12/2009 | Clem et al. | 166/242.1 |
| 2010/0025111 | A1 * | 2/2010 | Gearhart et al. | 175/48 |
| 2010/0089647 | A1 * | 4/2010 | Forster et al. | 175/57 |

OTHER PUBLICATIONS

Great Britain Report and Search Opinion for GB Application No. 1105920.1, dated May 4, 2011, 6 pages.

* cited by examiner

PULSE GENERATOR

TECHNICAL FIELD

The present invention relates to the field of downhole tools, and in particular to a pulse generator for use in a downhole tool.

BACKGROUND ART

The oil and gas exploration and extraction industry has learned that a percussive or hammer effect tends to increase the drilling rate that is achievable when drilling bores through hard rock. In such drilling operations, drilling fluid or "mud" is pumped from the surface through the drill string to exit from nozzles provided on the drill bit. The flow of fluid from the nozzles assists in dislodging and clearing material from the cutting face and serves to carry the dislodged material through the drilled bore to the surface. It has been recognized that providing a pulsing fluid flow from the nozzles may also serve to increase the drilling.

The industry has also learned that pulsation or agitation during directional drilling may have a similar beneficial effect, reducing stick-slip of the drill string in the directional wellbore, and improving weight transfer to the bit.

SUMMARY OF INVENTION

A downhole tool comprises a pulse generator that can generate longitudinal pulses in a drill string. A poppet is longitudinally moved in and out of an orifice in the pulse generator reducing the flow of drilling mud temporarily, generating a longitudinal pulse. The longitudinal pulse generator may be combined with a conventional transverse pulse generator to create a pulse generator capable of generating pulses in both transverse and longitudinal directions.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
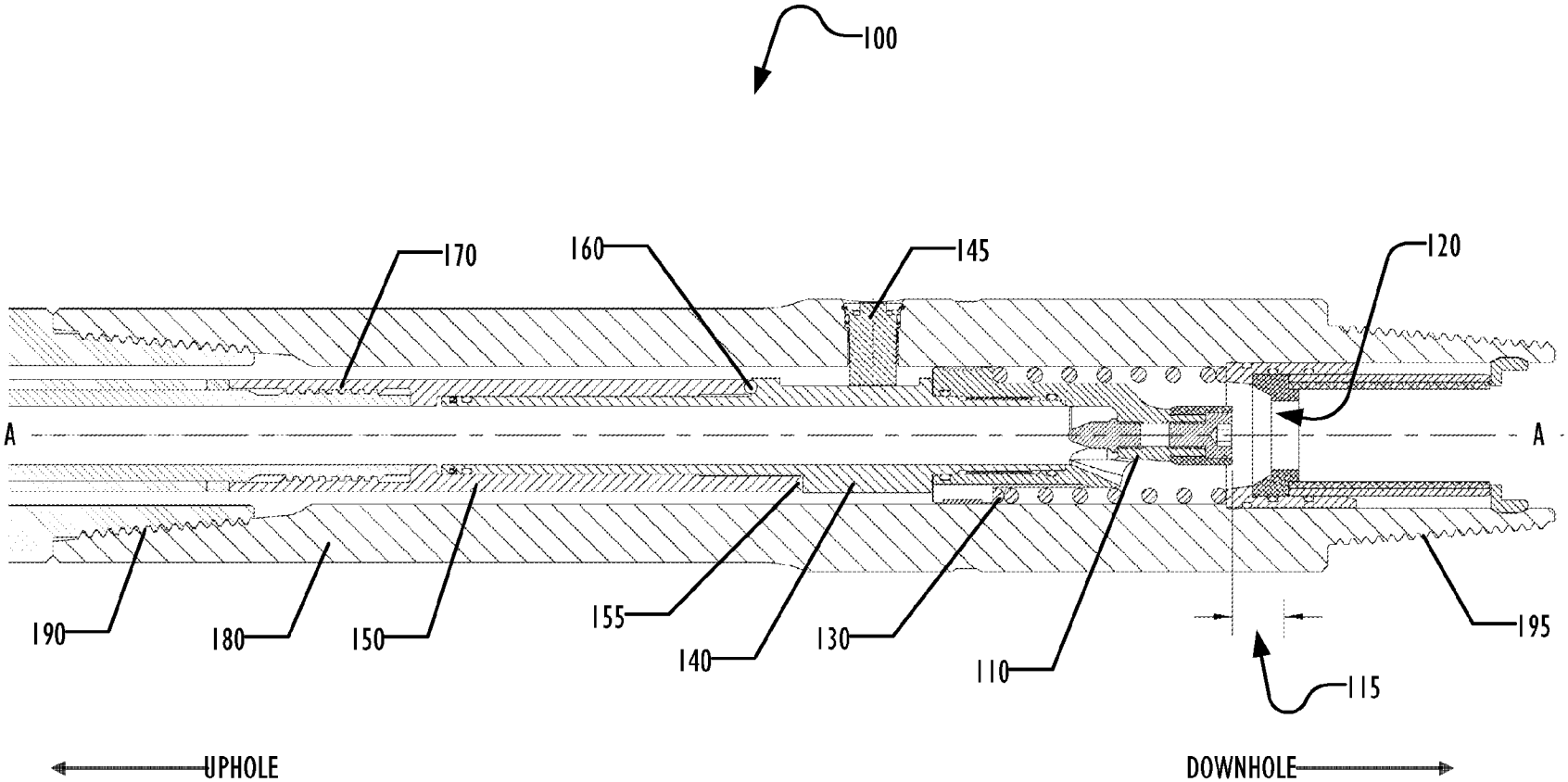
FIG. 1 is a cutaway side view illustrating a longitudinal pulse generator according to one embodiment, in an open position.

FIG. 1 is a cutaway side view illustrating a longitudinal pulse generator 100 for use in a downhole tool according to one embodiment. A tubular section 180 having a bore therethrough contains the longitudinal pulse generator movable elements and allows attachment of the longitudinal pulse generator 100 to a drill string. As illustrated in FIG. 1, the tubular section 180 is configured with a box threaded uphole end 190 and a pin threaded downhole end 195 for connection to other elements of a drill string (not shown). Other embodiments of the longitudinal pulse generator 100 can be manufactured with box-threaded sections on both ends, pin-threaded sections on both ends, etc., as desired.

Figure 5:
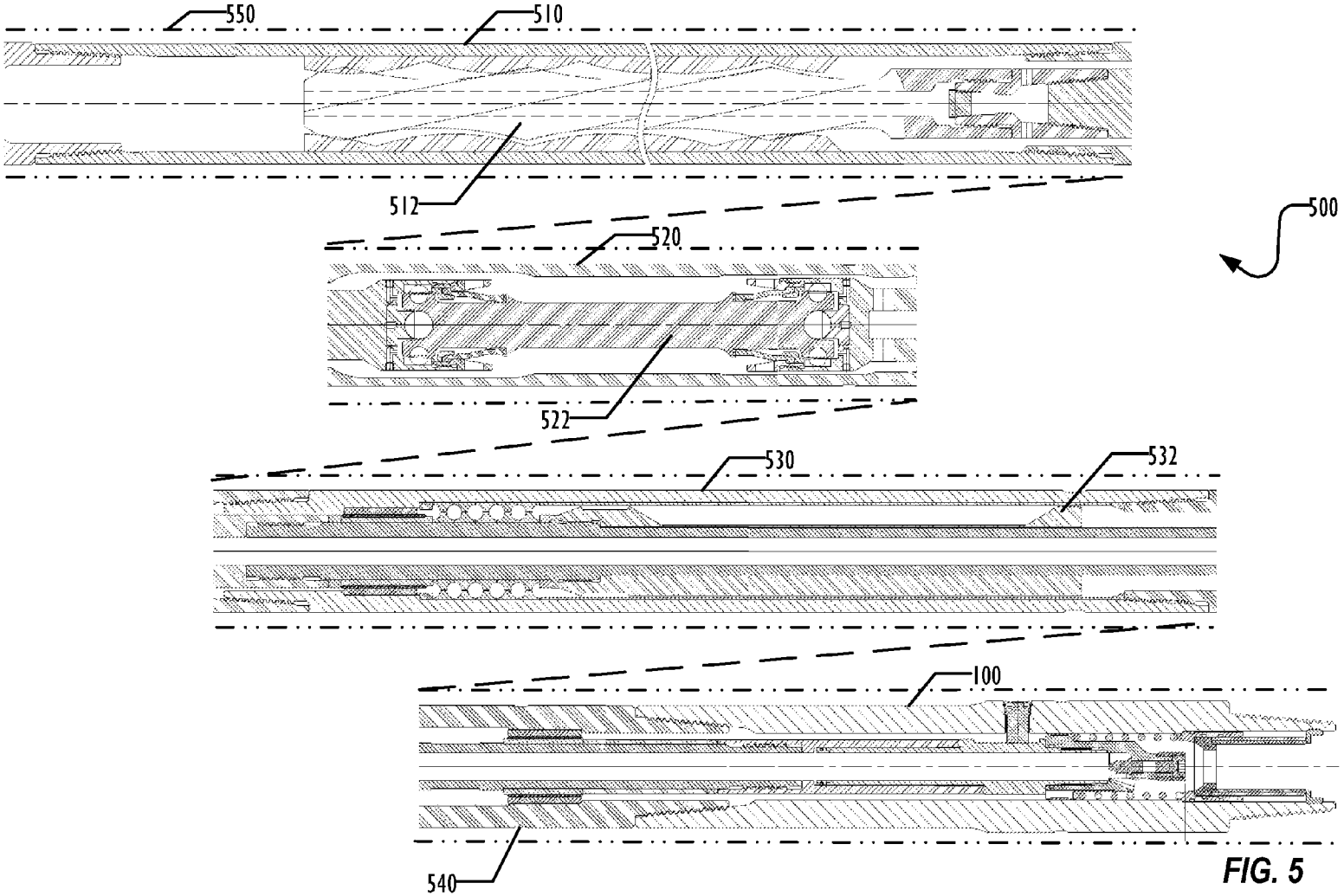
FIG. 5 is a cutaway side illustrating a 3-dimensional pulse generator according to one embodiment.

The tubular section 180 forms a stator for the pulse generator 100, with inner shaft 150 and secondary shaft 140 performing a rotor for the pulse generator 100. Inner shaft 150 is driven by a rotational power source, typically a positive displacement motor such as is illustrated in FIG. 5 and described below, although any desired technique for driving the pulse generator 100 may be used. As illustrated in FIG. 1, inner shaft 150 is threadedly connected to the rotational power source by threads 170.

On the downhole end of the inner shaft 150, a cam track 155 is machined at an incline relative to longitudinal axis A-A, where the inner shaft 150 engages secondary shaft 140. One or more bearings 160 are disposed in the cam track 155 and engage with in uphole surface of secondary shaft 140. Secondary shaft 140 is also machined with an opposing inclined angle relative to longitudinal axis A-A. Thus, rotation of inner shaft 150 causes longitudinal movement of secondary shaft 140 in a downhole direction along axis A-A, urging secondary shaft 140 in a downhole direction during one half of a rotation of inner shaft 150, and allowing secondary shaft 140 to move uphole during the other half of the rotation of inner shaft 150.

Figure 3:
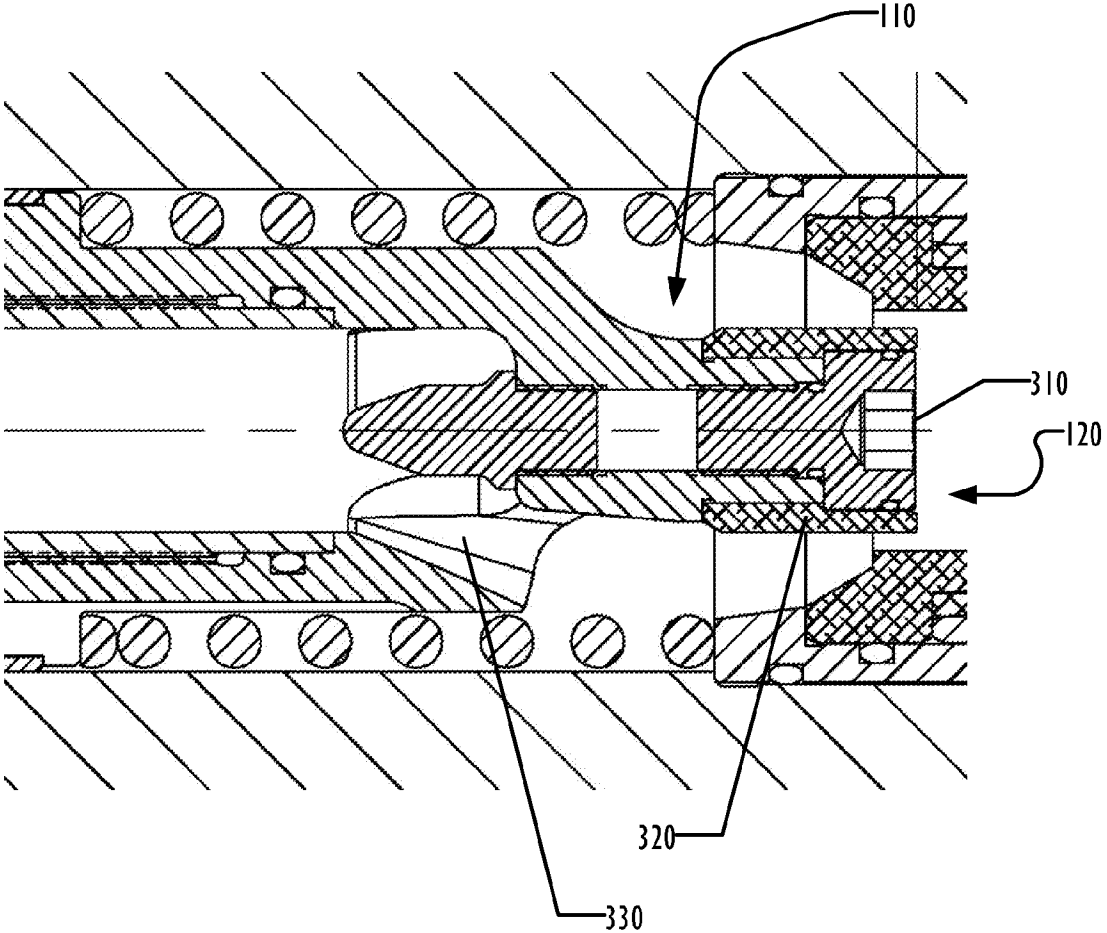
FIG. 3 is a cutaway side detail view illustrating a poppet for the longitudinal pulse generator of FIG. 1.

A spring-loaded poppet 110, described in more detail below with regard to FIG. 3, is connected to secondary shaft 140, typically using a threaded connection as illustrated in FIG. 1. Other connection techniques may be used as desired. In one embodiment, an anti-rotation pin 145 may be used to prevent rotation of the poppet 110 relative to the inner shaft 150. The spring 130 is disposed within the tubular section 180 and urges poppet 110 in uphole direction. Thus, during the half of the rotation of inner shaft 150 that allows movement of secondary shaft 140 in uphole direction, the spring 130 urges poppet 110 and secondary shaft 140 in uphole direction along longitudinal axis A-A.

Each complete rotation of inner shaft 150 therefore moves the poppet 110 in both directions along longitudinal axis A-A by a displacement of a predetermined longitudinal distance 115. FIG. 1 illustrates the relative position of the poppet 110 and an orifice 120 at one extreme of each stroke, leaving the orifice 120 open for fluid flow downhole.

Figure 2:
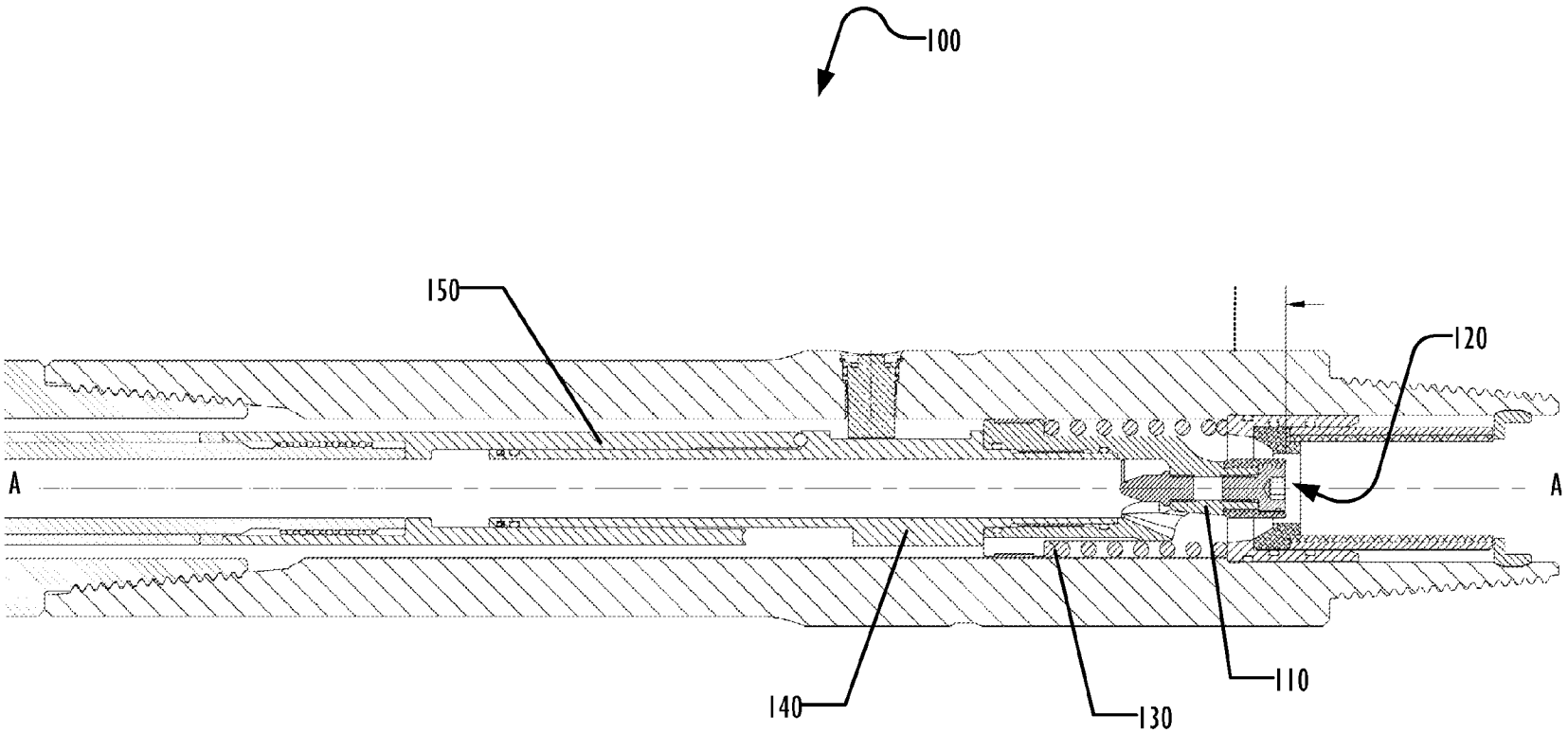
FIG. 2 is a cutaway side view illustrating a longitudinal pulse generator according to the embodiment of FIG. 1, in a closed position.

FIG. 2 is a cutaway side view illustrating the relative position of the elements of the pulse generator 100 when the poppet 110 is at the downhole extreme of each stroke. In the position illustrated by FIG. 2, poppet 110 is urged by the counter-inclined surfaces of inner shaft 150 and secondary shaft 140 so that an end of the poppet 110 enters the orifice 120. In that position, the poppet 110 partially occludes the orifice 120. In one embodiment, the poppet 110 occludes the majority of the orifice 120. The partial occlusion of the orifice 120 by poppet 110 as illustrated in FIG. 2 temporarily restricts fluid flow through the orifice 120, causing a pressure spike in the drill string. Poppet 110 does not completely occlude orifice 120, allowing some fluid flow to continue to the orifice 120 at all times during each stroke of the poppet 110.

The pressure spike caused by the temporary restriction of the orifice 120 by poppet 110 creates a water-hammer effect during each stroke of the poppet 110, which in turn creates mechanical shock and vibration loading in the tool string. The tool string is somewhat elastic, and the mechanical shock and vibration loading slightly changes the length of the tool string in a longitudinal direction. The mechanical shock and resulting longitudinal vibration reduces the coefficient of friction between the tool string and the borehole wall in a horizontal borehole. The reduced coefficient of friction allows the borehole to be drilled further than in conventional tool strings, reducing the limitations on the length of borehole that can be drilled in horizontal direction caused by the drag on the tool string that is in contact with the borehole.

As indicated above, further partial rotation of the inner shaft 150 allows the secondary shaft 140 and poppet 110 to move in uphole direction along axis A-A, urged by the spring 130, returning to the position illustrated in FIG. 1.

FIG. 3 is a cutaway side view illustrating the poppet 110 in more detail. In one embodiment, a plug 310 is inserted into the end of the poppet 110 to retain a jacket 320 disposed around the circumference of the poppet 110. In one embodiment, the jacket 320 is formed of a tungsten carbide material to prevent or reduce erosion of the poppet 110 that may be caused by fluid flow around the poppet 110, particularly during the time of reduced fluid flow that occurs on each stroke of the pulse generator 100 when the poppet 110 partially occludes the orifice 120, as illustrated in FIGS. 2 and 3. In one embodiment, jacket 320 is formed of a diamond-clad material, but other materials suitable for protecting the poppet 110 from erosion may be used as desired.

One or more of vanes 330 may be formed in uphole direction on the poppet 110 to direct fluid flow around the body of the poppet 110, reducing turbulence in the pulse generator 100, further reducing erosion caused by turbulent fluid flow around the poppet 110.

Figure 4:
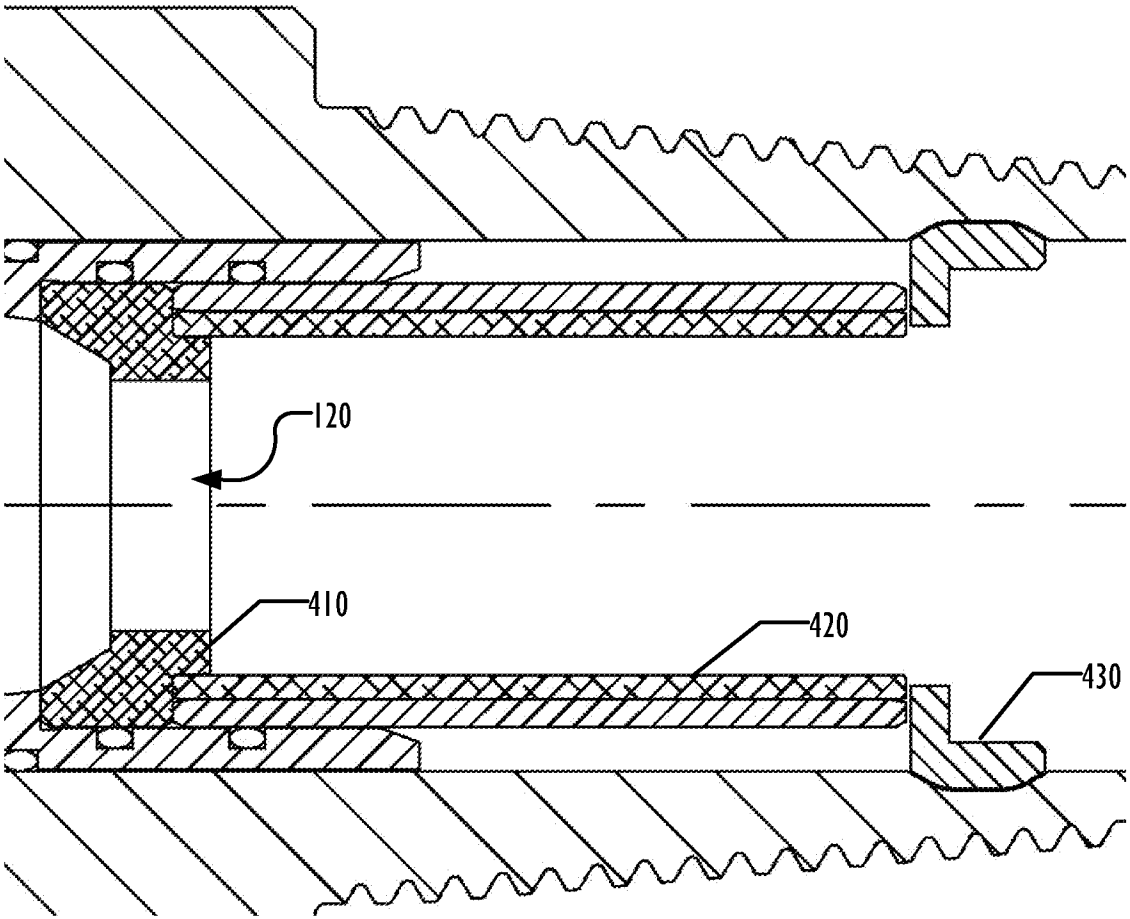
FIG. 4 is a cutaway side detailed view illustrating an orifice for the longitudinal pulse generator of FIG. 1.

FIG. 4 is a cutaway side view illustrating the orifice 120 and its surrounding surfaces according to one embodiment. As illustrated in FIG. 4, ring 410 forms the orifice 120. The orifice 120 has a smaller diameter than the bore of the tubular section 180. Ring 410 may be formed using a diamond clad or tungsten carbide material selected to resist erosion of the ring 410 during operation of the pulse generator 100 caused by fluid flow. A throat section 420 is positioned behind the ring 410 and held in place by retainer ring 430. In one embodiment, the throat section 420 is formed of a material selected to resist erosion of the caused by fluid flow. In one embodiment, the ring 410 and the throat section 420 may be replaced as desired to refurbish the pulse generator 100 by removing the retainer ring 430.

In one embodiment, the pulse generator 100 may be combined in a tool string with pulse generators that can generate transverse vibrations in the tool string, thereby providing a 3-dimensional pulse generator capable of generating both longitudinal and transverse vibrations in the tool string. Such a combined pulse generator may further reduce the coefficient of friction between the tool string and the borehole, further enhancing the ability to drill horizontally.

FIG. 5 is a cutaway side view illustrating one embodiment of a 3-dimensional pulse generator 500 in a borehole 550. As illustrated in FIG. 5, a positive displacement motor 512 in the power section 510 converts hydraulic energy from the drilling fluid into mechanical power to turn the pulse generator rotors. Drilling fluid is pumped into the power section 510 at a pressure that causes the rotor to rotate within the stator. This rotational force is then transmitted through a constant velocity (c.v.) shaft 522 in section 520 to the transverse pulse generator section 530 and the longitudinal pulse generator 100. Positive displacement motors are well known in the art and are not further described here.

Transverse pulse generators typically use the rotation of an eccentric mass, such as the eccentric mass built into rotor 532 illustrated in FIG. 5 to generate vibrations in one or more directions transverse to the rotational axis of the rotor 532. Transverse pulse generators are well known in the art, and are available from multiple manufacturers; therefore, the elements of a transverse pulse generator are not described in further detail herein. In one embodiment, a variable frequency drill string vibrator, such as the Xciter vibrator available from Xtend Energy Services, Inc., the assignee of the present application, may be used as the transverse pulse generator.

In one embodiment, an adaptor section 540 may be used to connect the transverse pulse generator section 530 to the longitudinal pulse generator 100, mechanically connecting the rotor 532 of the transverse pulse generator section 530 to the rotor of the longitudinal pulse generator 100 formed by inner shaft 150 and secondary shaft 140. The positive displacement motor 512 may thus drive both the transverse and longitudinal pulse generation mechanism, allowing generation of both transverse and longitudinal pulses simultaneously. In a less preferred embodiment, two positive displacement motors may be used, one driving the transverse pulse generator and the other driving the longitudinal pulse generator.

Other tool string sections are typically attached at the downhole and uphole ends of the tool string sections illustrated in FIG. 5, including a drilling bit section (not shown).

By connecting a conventional transverse pulse generator to a longitudinal pulse generator as described above, a combined downhole tool allows generation of pulses in three dimensions along the tool string. These 3-dimensional vibrations reduce frictional sticking and slipping in the borehole 550, and allow longer runs of horizontal drilling than can be achieved using transverse pulse generators alone, thus enhancing the efficiency of the horizontal drilling operation and reducing drilling costs. The downhole tool is not limited to horizontal or directional drilling applications, however; longitudinal vibrations may be useful for increasing weight on bit in certain vertical drilling operations.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A pulse generator for a downhole tool, comprising:
a tubular section having a bore therethrough along a longitudinal axis;
a first ring disposed in the bore of the tubular, forming an orifice; and
a poppet disposed in the bore of the tubular, operatively movable along the longitudinal axis of the tubular section between a first position and a second position;
a first shaft, connected to a rotational power source, comprising:
a cam track machined on an end of the first shaft, inclined relative to the longitudinal axis; and
a bearing disposed in the cam track;
a second shaft, adjacent the first shaft, comprising a surface inclined relative to the longitudinal axis disposed with the cam track, the second shaft connected to the poppet,
wherein a first half rotation of the first shaft urges the second shaft relative to the longitudinal axis from a first position to a second position, and
wherein a second half rotation of the first shaft allows the second shaft to move from the second position to the first position,
wherein the poppet in the second position partially occludes the orifice, causing a pressure spike in a drilling fluid flowing through the orifice,
wherein the poppet in the first position does not occlude the orifice, and
wherein the poppet does not rotate relative to the tubular section.

2. The pulse generator of claim 1, wherein the poppet in the second position occludes a majority of the orifice.

3. The pulse generator of claim 1, further comprising:
a spring, biased to urge the poppet from the second position to the first position.

4. The pulse generator of claim 1, further comprising:
a spring, biased to urge the poppet from the second position to the first position.

5. The pulse generator of claim 1, wherein the first ring is formed of a material selected for resistance to erosion by the drilling fluid.

6. The pulse generator of claim 5, wherein the material selected for resistance to erosion by the drilling fluid is diamond clad or tungsten carbide.

7. The pulse generator of claim 1, wherein the poppet further comprises:
a vane, configured to reduce turbulence in the drilling fluid as the drilling fluid passes over the poppet.

8. The pulse generator of claim 1, further comprising:
a throat section, disposed with the first ring distal from the orifice, wherein the throat section is formed of a material selected for resistance to erosion by the drilling fluid.

9. The pulse generator of claim 8, further comprising:
a second ring, disposed with the throat section, wherein the throat section is held in place against the first ring by the second ring.

10. The pulse generator of claim 1, further comprising:
a positive displacement motor, operatively coupled to the poppet,
wherein rotation of the positive displacement motor causes poppet to move between the first position and the second position.

11. A downhole tool, comprising:
a transverse pulse generator, configured to generate vibrations in one or more directions transverse to a rotational axis of the transverse pulse generator;
a longitudinal pulse generator, operatively connected to the transverse pulse generator, configured to generate vibrations along the rotational axis of the transverse pulse generator, comprising:
a tubular section having a bore therethrough along a longitudinal axis;
a first ring disposed in the bore of the tubular section, forming an orifice, the ring formed of a material selected for resistance to erosion by a drilling fluid;
a poppet disposed in the bore of the tubular section, operatively movable along the longitudinal axis of the tubular section between a first position and a second position; and
a spring, biased to urge the poppet from the second position to the first position;
a first shaft, connected to a rotational power source, comprising:
a cam track machined on an end of the first shaft, inclined relative to the longitudinal axis; and
a bearing disposed in the cam track;
a second shaft, adjacent the first shaft, comprising a surface inclined relative to the longitudinal axis disposed with the cam track, the second shaft connected to the poppet,
wherein a first half rotation of the first shaft urges the second shaft relative to the longitudinal axis from a first position to a second position, and
wherein a second half rotation of the first shaft allows the second shaft to move from the second position to the first position,
wherein the poppet in the second position partially occludes the orifice, causing a pressure spike in the drilling fluid flowing through the orifice,
wherein the poppet in the first position does not occlude the orifice, and
wherein the poppet does not rotate relative to the tubular section; and
a rotational power source, operatively connected to the transverse pulse generator and the longitudinal pulse generator.

12. The downhole tool of claim 11, wherein the rotational power source is a positive displacement motor, further comprising:
a constant velocity shaft, attached to the positive displacement motor and the transverse pulse generator.

13. The downhole tool of claim 11, further comprising:
an adaptor section, connected between the transverse pulse generator and the longitudinal pulse generator.

14. The downhole tool of claim 11, wherein the poppet further comprises:
a vane, configured to reduce turbulence in the drilling fluid as the drilling fluid passes over the poppet.

15. The downhole tool of claim 11, wherein the longitudinal pulse generator further comprises:
a throat section, disposed with the first ring distal from the orifice, wherein the throat section is formed of a material selected for resistance to erosion by the drilling fluid; and
a second ring, disposed with the throat section, wherein the throat section is held in place against the first ring by the second ring.

* * * * *